US006845535B2

(12) United States Patent
Phelps

(10) Patent No.: US 6,845,535 B2
(45) Date of Patent: Jan. 25, 2005

(54) POCKET KNIFE

(76) Inventor: Mehrunissa N. Phelps, 332 N. Hametown Rd., Akron, OH (US) 44333

( * ) Notice: Subject to any disclaimer, the term of this patent is extended or adjusted under 35 U.S.C. 154(b) by 54 days.

(21) Appl. No.: 09/947,615

(22) Filed: Sep. 6, 2001

(65) Prior Publication Data

US 2002/0075673 A1 Jun. 20, 2002

Related U.S. Application Data

(63) Continuation-in-part of application No. 09/550,194, filed on Apr. 17, 2000, now abandoned.

(51) Int. Cl.[7] ..... B26B 11/00
(52) U.S. Cl. ..... 7/118; 30/161; D8/100
(58) Field of Search ..... 30/160, 161; 7/118; 81/440, DIG. 5; D8/100

(56) References Cited

U.S. PATENT DOCUMENTS

| | | | | | |
|---|---|---|---|---|---|
| D11,750 | S | * | 4/1880 | Frary | D8/100 |
| D35,482 | S | * | 12/1901 | Maussner | D8/100 |
| 1,398,583 | A | * | 11/1921 | Bovee | 7/118 |
| 1,618,715 | A | * | 2/1927 | Lammers et al. | 81/DIG. 5 |
| 4,730,394 | A | * | 3/1988 | Sonner, Jr. | 30/161 |
| 5,442,529 | A | | 8/1995 | Hoover | |
| 5,653,525 | A | | 8/1997 | Park | |
| 5,727,319 | A | | 3/1998 | Myerchin et al. | |
| D411,431 | S | * | 6/1999 | Glesser | D8/100 |
| 6,027,224 | A | | 2/2000 | Schnell | |
| 6,145,202 | A | * | 11/2000 | Onion | 30/160 |
| 6,145,994 | A | | 11/2000 | Ng | |
| 6,182,541 | B1 | * | 2/2001 | Anderson et al. | 81/440 |
| 6,257,098 | B1 | * | 7/2001 | Cirone | 81/DIG. 5 |
| 6,434,831 | B2 | * | 8/2002 | Chen | 30/161 |
| 6,490,797 | B1 | * | 12/2002 | Lake et al. | 30/161 |
| 6,523,265 | B2 | * | 2/2003 | Eickhorn | 30/161 |
| 2001/0023541 | A1 | * | 9/2001 | Blanchard | 30/161 |
| 2002/0104220 | A1 | * | 8/2002 | Marifone | 30/160 |

FOREIGN PATENT DOCUMENTS

| | | | |
|---|---|---|---|
| EP | 0 847 848 A1 | 6/1998 | B29C/70/78 |

* cited by examiner

*Primary Examiner*—James G. Smith

(57) ABSTRACT

A pocket implement magazine includes, first and second longitudinally extending, spaced apart, parallel structural members providing an interior space therebetween, with a pivot pin extending between the first and second structural members. A pivot implement is rotatably received in the interior space by the pivot pin, the pivot implement having a functional area, with an associated operational latch hole, opposite a rotational end, with an associated storage latch hole. The pivot implement is capable of rotating from a closed to an open position and back to the closed position. A latch assembly communicates with the pivot implement and selectively allows for rotation of the pivot implement and selectively locks the pivot implement in the closed or open position. This latch assembly includes, a latch housing, a rotation handle operable to cause rotation of the latch housing, a spring disposed within the latch housing, a latch biased by the spring to extend exteriorly of the latch housing and engage the operational latch hole of the pivot implement, when the pivot implement is in the open position and engage the storage latch hole, when the pivot implement is in the closed position. The present invention also provides for the quick identification of individual implements through the use of labels placed on either the face of the pocket implement magazine's lateral sides or on the latch assemblies.

4 Claims, 3 Drawing Sheets

Expanded Outside Side View
Spring Latch Assembly 11

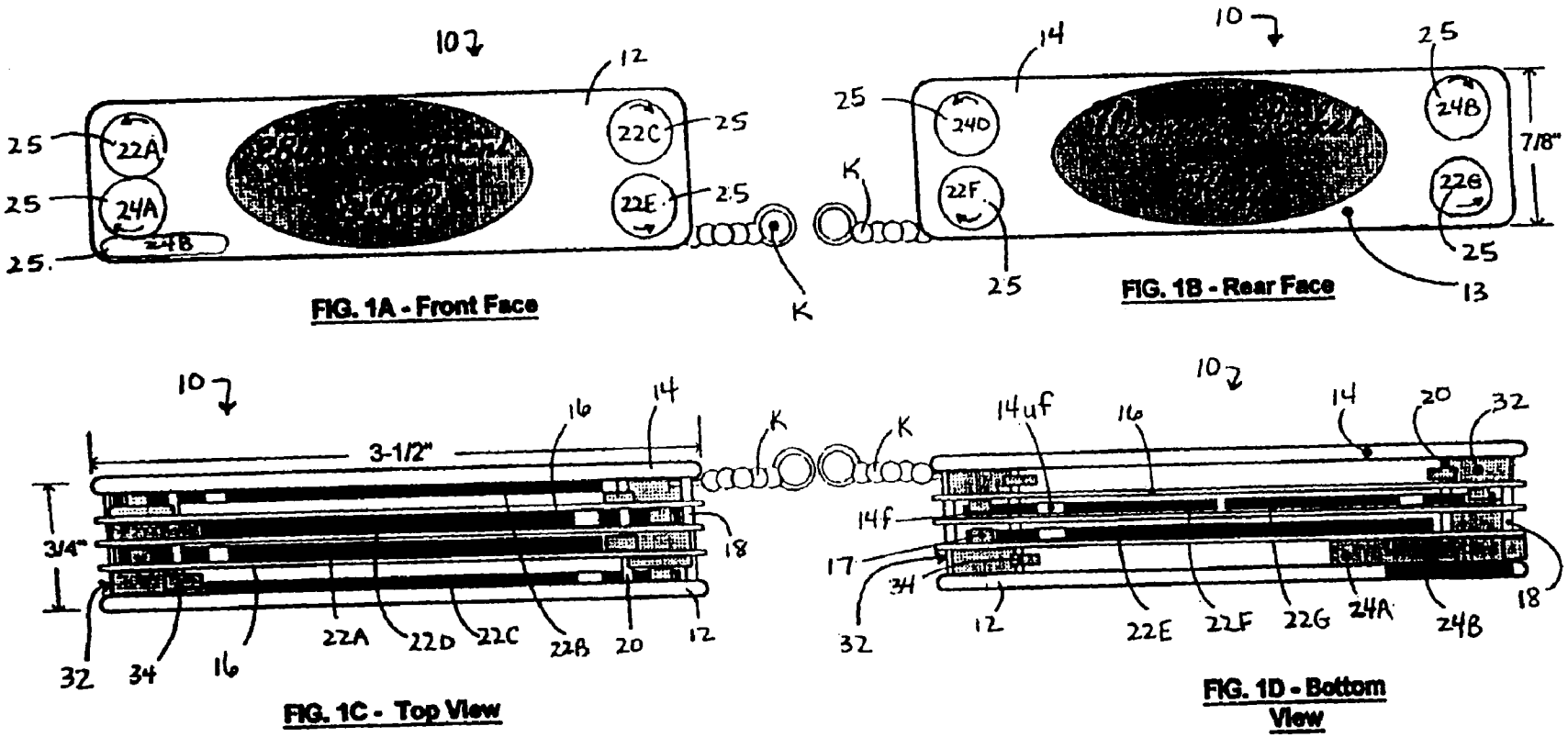
FIG. 1A - Front Face
FIG. 1B - Rear Face
FIG. 1C - Top View
FIG. 1D - Bottom View

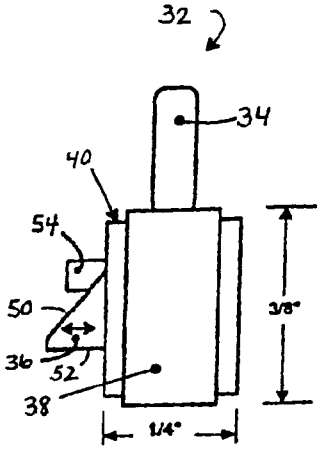
FIG. 2A - Expanded Outside Side View Spring Latch Assembly 11
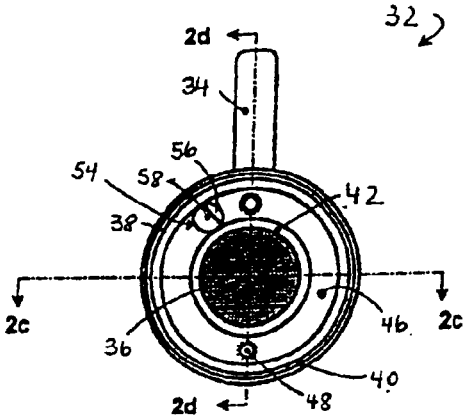
FIG. 2B - Expanded Outside End View Spring Latch Assembly 11
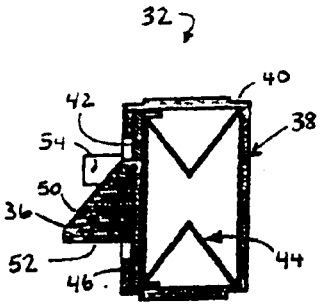
FIG. 2C - View 2c-2c Expanded Sectional Plan Rotated 90 Degrees Clockwise
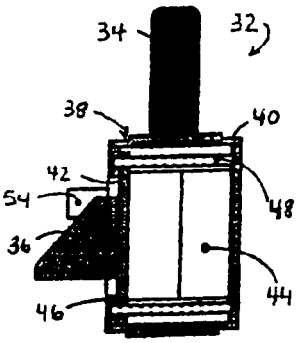
FIG. 2D - View 2d-2d Expanded Sectional Side
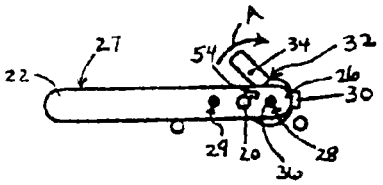
FIG. 2E - Schematic of Implement Closed Mechanics
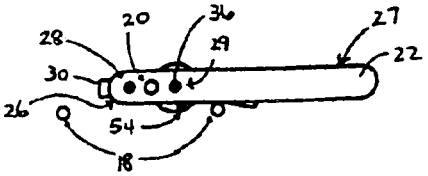
FIG. 2F - Schematic of Implement Open Mechanics

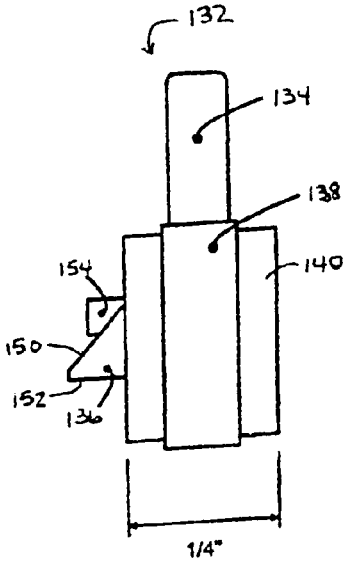
FIG 3A - Side View
Spring Latch Assembly 11
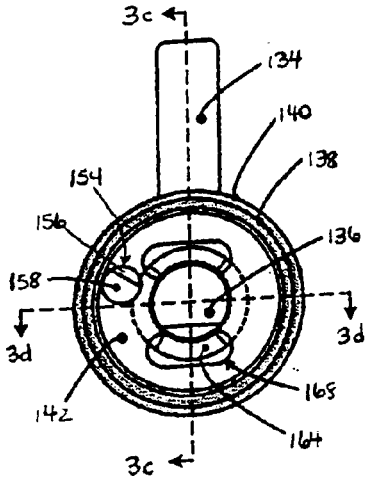
FIG. 3B - Front View
Latch End of Assembly 11
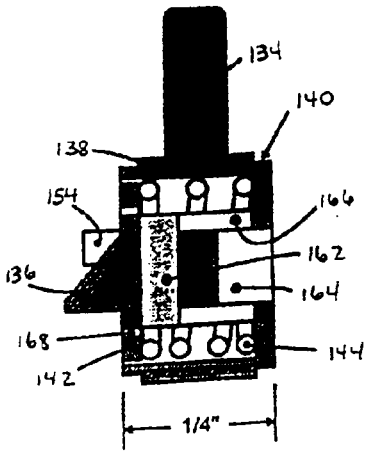
FIG. 3C - Sect. View 3c-3c
Spring Latch Assembly 11
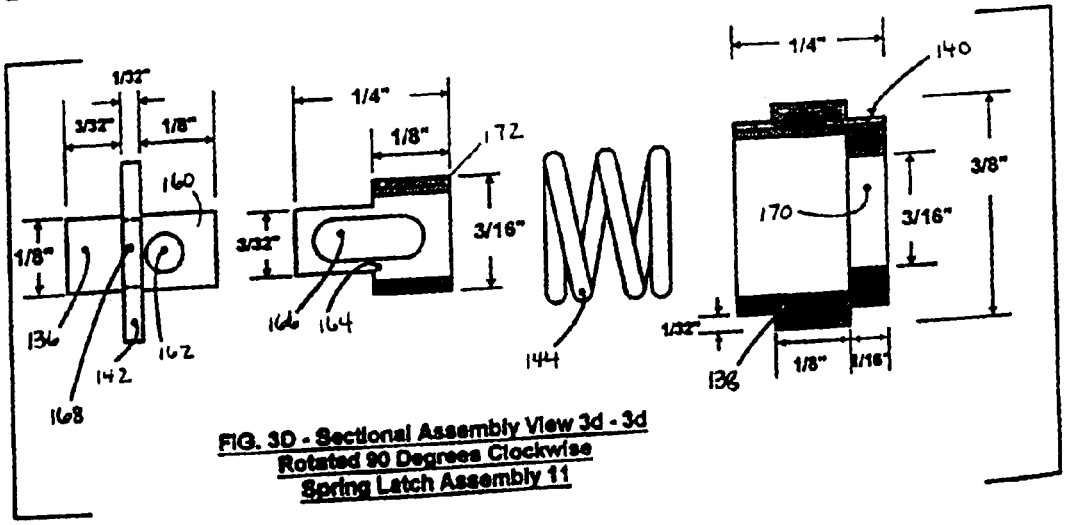
FIG. 3D - Sectional Assembly View 3d - 3d
Rotated 90 Degrees Clockwise
Spring Latch Assembly 11

POCKET KNIFE

RELATED APPLICATIONS

This application is a continuation-in-part of U.S. patent application Ser. No. 09/550,194 filed Apr. 17, 2000 now abandoned.

TECHNICAL FIELD

The present invention is directed to pocket knives. More particularly, the present invention is directed to pocket knifes that have readily identifiable implements that can be easily opened.

BACKGROUND OF THE INVENTION

A pocket knife is a tool that holds one or more implements stored in a retracted position when not in use. When an implement is selected for use, it is typically pivoted outwardly and rotated about 180°. The types of implements generally included in a pocket knife are well known in the art and may include knife blades, screwdrivers or other tools, files, combs, bottle openers, scissors, cuticle trimmers, and corkscrews, among others.

Generally, the implements are difficult to open to the use position. The motion of the implements is stiff so that the implements remain in a fixed position during use. To aid in opening of the implements, either nail marks or indentations in the implements have been provided to allow a user to partially release the implement in order to then grasp and rotate it to its use position. Unfortunately, persons with weak, long, or damaged fingernails have difficulty manipulating such implements. Implement manipulation can be particularly difficult for women who grow long fingernails, or who wear artificial fingernails.

Additionally, as more implements are added to a pocket knife, it becomes more difficult for a person to select a desired implement. Many times the correct implement is selected only after trial and error. This problem stems from the fact that similar implements are difficult to distinguish when they are in a stored position within the pocket knife.

What is needed in the art is a pocket knife with implements that can be readily identified. Also needed in the art, is a pocket knife with implements that are readily opened without the use of fingernails.

SUMMARY OF THE INVENTION

In general the present invention provides a pocket implement magazine including, at least two longitudinally extending, spaced apart, parallel lateral sides providing an interior space therebetween, each lateral side having an exterior face. At least one pivot implement is disposed in the interior space and is capable of being rotated from a closed to an open position and back to the closed position. At least one label is provided on the exterior face of at least one of the lateral sides and positioned thereon near where the at least one pivot implement may be manipulated to rotate between the open and closed positions.

In another embodiment, the present invention also provides a pocket implement magazine including, first and second longitudinally extending, spaced apart, parallel structural members providing an interior space therebetween, with a pivot pin extending between the first and second structural members. A pivot implement is rotatably received in the interior space by the pivot pin, the pivot implement having a functional area, with an associated operational latch hole, opposite a rotational end, with an associated storage latch hole. The pivot implement is capable of rotating from a closed to an open position and back to the closed position. A latch assembly communicates with the pivot implement and selectively allows for rotation of the pivot implement and selectively locks the pivot implement in the closed or open position. This latch assembly includes, a latch housing, a rotation handle operable to cause rotation of the latch housing, a spring disposed within the latch housing, a latch biased by the spring to extend exteriorly of the latch housing and engage the operational latch hole of the pivot implement when the pivot implement is in the open position and engage the storage latch hole when the pivot implement is in the closed position.

BRIEF DESCRIPTION OF THE DRAWINGS

FIGS. 1A to 1D show the front, rear, top, and bottom views of a pocket knife according to a preferred embodiment of the present invention;

FIGS. 2A to 2D show expanded views of the latch assembly of the pocket knife of the preferred embodiment shown in FIGS. 1A to 1D;

FIGS. 2E and 2F schematically show the implement open and close mechanics; and FIGS. 3A to 3D show expanded views of the latch assembly with an optional means of making the internal mechanics of said latch assembly.

DETAILED DESCRIPTION OF THE INVENTION

Provided is a pocket knife. More generally, a pocket knife may be called an implement magazine, which may include other implements in addition to a knife blade. Throughout this disclosure, the more common term "pocket knife" is used, but the term pocket knife is not limited to implement magazines containing only knife implements.

Referring now to FIGS. 1A to 1D, it can be seen that the pocket knife of the present invention is designated generally by the numeral 10. Pocket knife 10 has two longitudinally extending, spaced apart, substantially parallel lateral sides 12, 14 providing an interior space therebetween. Lateral sides 12, 14 provide the exterior surface of the pocket knife 10, and, as such, they may be inscribed with optional lettering or symbols. A plurality of structural members 16 are disposed within this interior space, substantially parallel to lateral sides 12, 14. In the Figures, three structural members 16 are shown, but as known in the art the number of structural members 16 can be varied depending upon the number of implements to be retained in a pocket knife 10.

Lateral sides 12, 14 as well as the plurality of structural members 16 are secured to one another by a securing means to maintain the entire unit in a fixed relationship. Generally, as shown in the Figures, the securing means can be pins, such as implement stop pins 18 and implement pivot pins 20, or the securing means can be provided through other structures forming an integrated unibody design. Particularly, with respect to Figures. Implement stop pins 18 may also serve as stops for rotation of implements, as will be later explained. Implement pivot pins 20 extend between two or more structural members 16 and serve as implement holding and pivot points about which the implements rotate as they unfold into a use position. In FIGS. 1A–1D, there are two implement stop pins 18 and four implement pivot pins 20, but the actual number of pins depends upon the size of the pocket knife and the number of implements. Spacer sleeves may be mounted over pins 18 and 20 to fix the dimensions between structural members 16.

The exemplary implements of the embodiment shown in FIGS. 1A–1D include pivot implements 22A–G and non-pivot implements 24A and 24B. As mentioned above, one or more implements 22 or 24 are disposed within the interior space formed by lateral sides 12, 14. The pivot implements 22 are anchored within the interior space by implement pivot pins 20. The pivot implements 22 may be rotated from a closed position, within the interior space, to an open position for use. Pivot implements selected for this embodiment include cuticle trimmers 22A, scissors 22B, file and cleaner 22C, comb 22D, knife 22E, combination bottle opener and flat head screwdriver 22F, and cuticle care 22G (a cuticle pusher and cleaner, which can be metal or an orange stick). Non-pivot implements selected for this embodiment include pin light 24A, and tweezers 24B.

Generally, a pivot implement 22 is rotated about 180° into an open or use position; however, the pivot implements 22 can be rotated to any position desired by a user. For instance, as is well known, pocket knives may include a corkscrew implement that is rotated 90° to its position of use. As for the non-pivot implements 24, these may include implements that are permanently mounted in the interior space of the pocket knife, such as pin light 24A, with a battery source (not shown). Pocket knives may also contain non-pivot implements 24 that are selectively stored in a cavity within the lateral sides 12, 14 of the pocket knife. These types of non-pivot implements 24 are pulled out of the recessed cavity for use, and, as a non-limiting example, may include tweezers 24B stored in the cavity.

In one embodiment, the implements, both pivot 22 and non-pivot 24, are labeled so that the desired implement 22 or 24 can be chosen without trial and error. One method of identifying the implements 22 or 24 includes placing labels 25 on the exterior face of the lateral sides 12, 14. The label 25 is placed on the face of the lateral sides 12, 14 near where the implement 22 or 24 is either attached to or selectively stored in the pocket knife 10. A user can then determine where each implement 22 or 24 is located relative to the pocket knife 10 as a whole. The labels 25 maybe applied as a decal, or may be printed, engraved, stamped, inlaid, or otherwise placed on the exterior face of the lateral sides 12, 14.

Optionally, a key chain K can be attached to a stop pin 18 or structural member 16. The key chain may be terminated with a key ring, for attaching keys, or it may be terminated with a clip. The clip can allow a user to attach the pocket knife to an article, such as a belt, a belt loop, or purse strap, for easy access. In place of the key chain, a lanyard may be substituted.

In another embodiment, explained next below, pivot implements 22 can be opened by applying leverage to a rotation handle 34 or 134 of a latch assembly 32 or 132 to rotate the pivot implement 22 into an open position. In such an embodiment, another method of identifying the implements includes labeling the rotation handles 34. Yet another method includes placing labels 25 on the free end of such latch assemblies 32, 132 by projecting the latch assembly through a lateral side 12 or 14. These methods will become more apparent from the disclosure of latch assembly 32 and latch assembly 132 herein below.

Referring now to FIGS. 2E and 2F, wherein adjacent structural members 16 have been removed in order to better display a generic pivot implement 22 and its opening and closing functions, it will be seen that each pivot implement 22 includes a rotational end 26 disposed on one side of the associated implement pivot pin 20, and a functional area 27 disposed on the other side thereof. A storage latch hole 28 is provided in rotational end 26, a set distance from implement pivot pin 20, and an operational latch hole 29 is provided in functional area 27 at the same offset distance. Rotational end 26 also includes an implement gear tooth 30. Storage latch hole 28, operational latch hole 29, and implement gear tooth 30 cooperate with a latch assembly 32 to achieve rotation of pivot implement 22 from its storage position to its use position.

In FIGS. 1C, 1D, and 2A, it can be seen that a latch assembly 32 is associated with each pivot implement 22. Particularly, latch assembly 32 is retained either between two structural members 16 or between a structural member 16 and a lateral side 12 or 14. Each latch assembly 32 includes a handle 34 and a latch 36, which extends through a bore (not shown) in an adjacent structural member 16 to engage storage latch hole 28 when the associated pivot implement 22 is in the stored position. For reasons that will become apparent more fully below, latch 36 is spring biased to extend exteriorly of latch housing 38, although this spring bias may be overcome to force latch 36 to move inside of latch housing 38. With particular reference to FIG. 2A, latch assembly 32 includes mounting rims 40, which, according to the location of a particular latch assembly 32, engage with holes drilled into either adjacent structural members 16 or a structural member 16 and an adjacent lateral side 12 or 14 to hold the latch assembly 32 therebetween. If desired, bearing plate washers (not shown) can be installed at these drilled holes to assist the rotation of latch assembly 32 therein.

With reference to FIGS. 2A–2D, latch 36 is mounted on a latch slide plate 42, which is biased to the position shown in FIGS. 2C and 2D (i.e., with latch 36 extending exteriorly of latch housing 38) by a spring 44. Latch slide plate 42 is retained in latch housing 38 by latch retaining ring 46, which is connected to latch housing 38 by thread connections. Latch slide pins 48 are installed into latch housing 38 by threaded connections, or other means, such as, brazing, welding, soldering, or adhesive bonding, and serve to guide the axial movement of latch 36 as it loads or unloads spring 44 as will be described below. The portion of latch 36 extending exteriorly of latch housing 38 engages with storage latch hole 28, when implement 22 is in the stored position, and engages with operational latch hole 38, when implement 22 is in its operative position.

More particularly, latch 36 is beveled such that, as shown in FIGS. 2A, 2C, and 2D, it provides a sloped surface 50 and a lock surface 52. As seen in FIG. 2B, latch 36 is preferably cylindrical such that lock surface 52 is rounded. Surface 52 is called a "lock" surface because it serves to selectively lock the pivot implement 22 associated therewith in the use and storage positions. That is, when latch assembly 32 and an associated pivot implement 22 are in the stored position as shown in FIGS. 1C and 1D, the pivot implement 22 cannot be rotated to the use position because, upon an attempt to rotate the pivot implement 22 about implement pivot pin 20, storage latch hole 28 must necessarily move downwardly, and, in the stored position, lock surface 52 of latch 36 prevents such movement.

Referring back to FIGS. 2E and 2F, the operation of a latch assembly 32 is generally depicted. As mentioned, the latch assembly 32 may be rotated. Rotation is achieved by manipulation of handle 34, in the direction of arrow A. During rotation, latch 36 rotates within storage latch hole 28, latch 36 being on the axis of rotation for latch assembly 32. During such rotation, sloped surface 50 and lock surface 52 of latch 36 begin to switch positions, and, eventually, implement 22 may rotate about implement pivot pin 20 because downward movement of storage latch hole 28 will cause the upper surface thereof to push against sloped surface 50 instead of lock surface 52, and will force latch 36 against spring 44 and into latch housing 38. More particularly, latch assembly 32 includes a latch gear tooth 54, which is shown in phantom in FIG. 2E, as it lies behind pivot implement 22. As can be envisioned from FIG. 2E, upon rotation of latch assembly 32 by means of handle 34, latch gear tooth 54 contacts implement gear tooth 30 and, upon any further rotation of latch assembly 32, causes pivot implement 22 to rotate slightly about its associated implement pivot pin 20, and partially unfold. As already mentioned, this partial unfolding is possible do to the fact that, upon rotation of latch assembly 32, sloped surface 50 of latch 36 gradually switches positions with lock surface 52.

Once the associated pivot implement 22 is partially unfolded, it is easily grasped and further pivoted around implement pivot pin 20 to its use position. Upon reaching the use position, as shown in FIG. 2F, operational latch hole 29 engages latch 36, which, in its rotated position, now has its lock surface 52 engaging the downward side of operational latch hole 29. Pivot implement 22 is therefore locked in the use position because, in order to pivot implement 22 around implement pivot 20 and into the storage position, operational latch hole 29 must necessarily move upwardly, and it cannot be moved in this manner, due to the fact that such movement is prevented by lock surface 52. Thus, the generally functioning of a latch assembly 32 should now be appreciated. Additionally of note in FIGS. 2E and 2F, implement stop pins 18 help define the positioning of an implement 22 in both the storage and use position.

When it is desired to move a pivot implement 22 from its use position to its storage position, handle 34 is manipulated in the opposite direction such that latch 36 again reverses positioning so that implement 22 may be pivoted around implement pin 20, with operational latch hole 29 engaging sloped surface 50 of latch 36 to force latch 36 into latch housing 38 and allow pivot implement 22 to rotate to the storage position.

Latch gear tooth 54 is also beveled, like latch 36, but is smaller in size. It is also mounted on latch slide plate 42, and is placed thereon such that its contact surface 56 contacts implement gear tooth 50 to cause the partial opening of pivot implement 22, and, upon returning latch assembly 32 to the storage position, its sloped surface 58 contacts implement 22 in its locked open position, and latch gear tooth 54 loads spring 44 and is pushed inward so that it may pass implement 22, as shown in phantom in FIG. 2E.

With reference to FIG. 3A–3D, an alternative embodiment of a latch assembly is provided and designated by the numeral 132. Therein, parts functioning similarly to parts of the latch assembly of FIGS. 2A–2D receive like numerals increased by 100. Thus, latch assembly 132 includes handle 134, a beveled latch 136, having a sloped surface 150 and lock surface 152, a latch housing 138, and mounting rims 140.

FIGS. 3A–3D show an optional structure for spring latch assembly 32, which substitutes coil spring 144 for the plate spring 44 of the embodiment of FIGS. 2A–2D. Coil spring 144 exerts force on latch slide plate 142 to biased latch 136, which is integral with latch slide plate 142, to a position external of latch housing 138. Latch 136 and latch slide plate 142 are also integral with a slide member 160, which has extending therefrom a slide pin 162. This integral structure of latch 136, latch slide plate 142, slide member 160, and slide pin 162, communicate with latch slide 164, with slide pin 162 being received in guide slots 166 of latch slide 164 to provide stops for axial and rotational movement of this integral unit. Latch slide plate 142 is also modified with penetration slots 168, which allow latch slide plate 22 to move axially along latch slide 164. In this alternate embodiment, latch housing 138 provides a mounting bore 170 for latch slide 164, and threads 172 of latch slide 164 engage mounting bore 172 to retain latch slide 164 and the integral structure of latch 136, latch slide plate 142, slide member 160 and slide pin 162 in connection with latch housing 138. It will be appreciated that, while latch slide 164 engages mounting bore 172 with threaded engagement, other means, such as brazing, welding, soldering or adhesive bonding may be employed.

Latch assembly 132 also contains a latch gear tooth 154 having a contact surface 156 and sloped surface 158. The functioning of latch assembly 132 is substantially identical to the functioning of latch assembly 32. That is, a latch assembly 132 is associated with a pivot implement 22 and is disposed on the other side of a structural member 16 adjacent thereto. Latch assembly 132 is retained in its position by mounting rims 140 received in bores in structural members and/or lateral sides 12, 14, 16. Latch 136 engages the storage latch hole 28 of the pivot implement, when the pivot implement 22 is in the storage position. The lock surface 152 of latch 136 prevents pivot implement 22 from being pivoted to its use position. In order to open a pivot implement 22, handle 134 is rotated such that lock surface 152 and sloped surface 150 of latch 136 begin to reverse positions, and latch gear tooth 150, particularly its contact surface 156, is moved towards contact with implement gear tooth 30. When latch gear tooth 154 engages implement gear tooth 30, sloped surface 150 of latch 136 is position such that pivot implement 22 may be rotated around implement pivot pin 20, because storage latch hole 28 presses against sloped surface 150 and forces latch 136 into latch housing 138, and latch 136 no longer impedes the rotation of implement 22. As mentioned above with respect to latch assembly 32, this process is essentially reversed to close a pivot implement 22 to the storage position.

Generally, the pocket knife can have any desired dimension. The dimensions will be determined by the size and number of implements chosen to include in the pocket knife. Generally, a pocket knife has dimensions that allow it to be placed in a pocket. Pocket size is not limiting if the pocket knife is not carried within a pocket. Preferably, a pocket knife will have a length of about 2½ inches to about 4 inches, a height of about ⅝ inches to about 1⅛ inches, and width of about ½ inches to about 1 inch. More preferably, the pocket knife has a length of about 3.5 inches, a heights of about ⅞ inch, and a width of about ¾ inch.

The materials for fabricating the pocket knife can be fabricated from any structural metal. Typically, the metal for the implements will be a stainless steel. Typically, the pin light will preferably be fabricated from plastic to save on weight and cost; however, the pin light may be fabricated from a metal.

The above embodiments show the pocket knife with the preferred structural members. As an alternative, more implements can be added to the pocket knife by adding additional structural members, thereby allowing more implement to be disposed between the structural members.

It should be appreciated that the present invention is not limited to the specific embodiments described above, but includes variations, modifications and equivalent embodiments defined by the following claims.

What is claimed is:

1. A pocket implement magazine comprising:

first and second longitudinally extending, spaced apart, parallel structural members providing an interior space therebetween;

a pivot pin extending between said first and second structural members;

a pivot implement being rotatably received in said interior space by said pivot pin, said pivot implement having a functional area, with an associated operational latch hole, opposite a rotational end, with an associated storage latch hole, said pivot implement being capable of rotation from a closed position to an open position and back to the closed position; and a latch assembly communicating with said pivot implement and selectively allowing for rotation of said pivot implement and selectively locking said pivot implement in the closed or open position, said latch assembly comprising:

a latch housing;

a rotation handle operable to cause rotation of said latch housing;

a spring disposed within said latch housing;

a latch biased by said spring to extend exteriorly of said latch housing and engage said operational latch hole of said pivot implement when said pivot implement is in the open position and engage said storage latch hole when said pivot implement is in the closed position.

2. The pocket implement magazine of claim 1, wherein said latch includes a lock surface and a sloped surface, said lock surface, at proper orientation, serving to lock said pivot implement in either the open or closed position, and said sloped surface, at proper orientation, serving to allow for the rotation of said pivot implement from one of the open or closed positions to the other.

3. A pocket implement magazine according to claim 2, wherein said latch assembly selectively pivots between a storage position, wherein said lock surface of said latch communicates with said storage latch hole of said pivot implement to prevent rotation of said pivot implement about said pivot pin, and an operative position, wherein said sloped surface of said latch communicates with said storage latch hole to allow for the rotation of said pivot implement to the open position.

4. A pocket implement magazine according to claim 1, further comprising an exterior front lateral face and an exterior rear lateral face and a label on either one of said front or rear lateral faces or on said latch assembly, said label identifying said pivot implement.

* * * * *